United States Patent [19]

Thomson

[11] 4,127,296

[45] Nov. 28, 1978

[54] HOLDER FOR AN IMPLEMENT

[76] Inventor: John D. Thomson, 73 Wallaroy Rd., Woollahra, Sydney, Australia

[21] Appl. No.: 850,090

[22] Filed: Nov. 8, 1977

[30] Foreign Application Priority Data

Nov. 16, 1976 [AU] Australia ..... 8159/76

[51] Int. Cl.[2] ..... A47F 13/06

[52] U.S. Cl. ..... 294/19 R; 15/144 R

[58] Field of Search ..... 294/79 R, 21, 22, 23, 294/1 R, 7, 43, 42; 15/144 R, 146 A, 146

[56] References Cited

U.S. PATENT DOCUMENTS

| | | | |
|---|---|---|---|
| 3,737,187 | 6/1973 | Pryor | 294/19 R |
| 3,778,860 | 12/1973 | Thielen | 15/144 A |

FOREIGN PATENT DOCUMENTS

| | | | |
|---|---|---|---|
| 1,215,855 | 4/1960 | France | 15/144 R |

*Primary Examiner*—James B. Marbert

*Attorney, Agent, or Firm*—Emory L. Groff, Jr.

[57] ABSTRACT

The invention relates to an extension holder for various implements, e.g., a paint brush, the holder giving a degree of flexibility such is normally achieved by the wrist movement with hand-held implements.

7 Claims, 7 Drawing Figures

FIG. 7
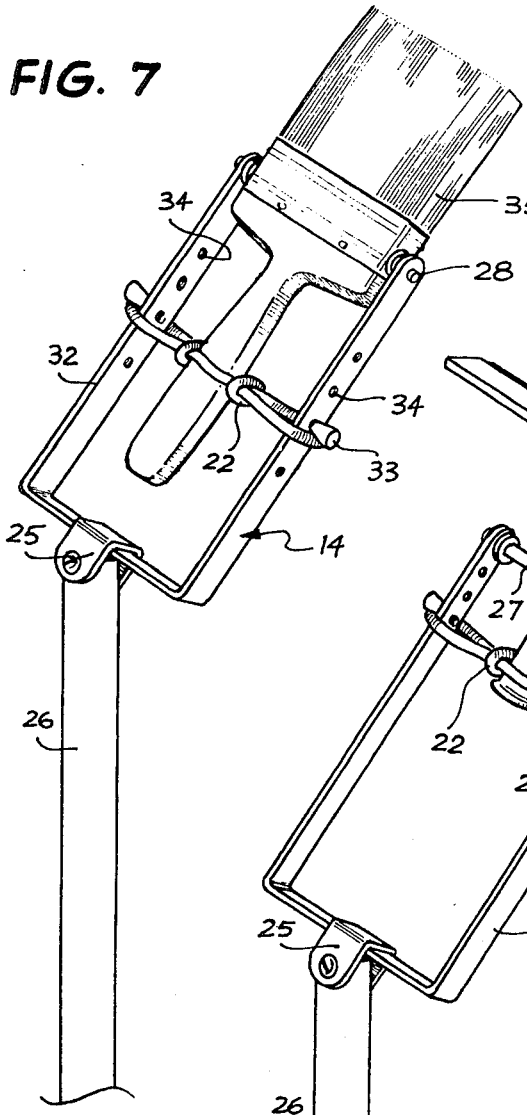
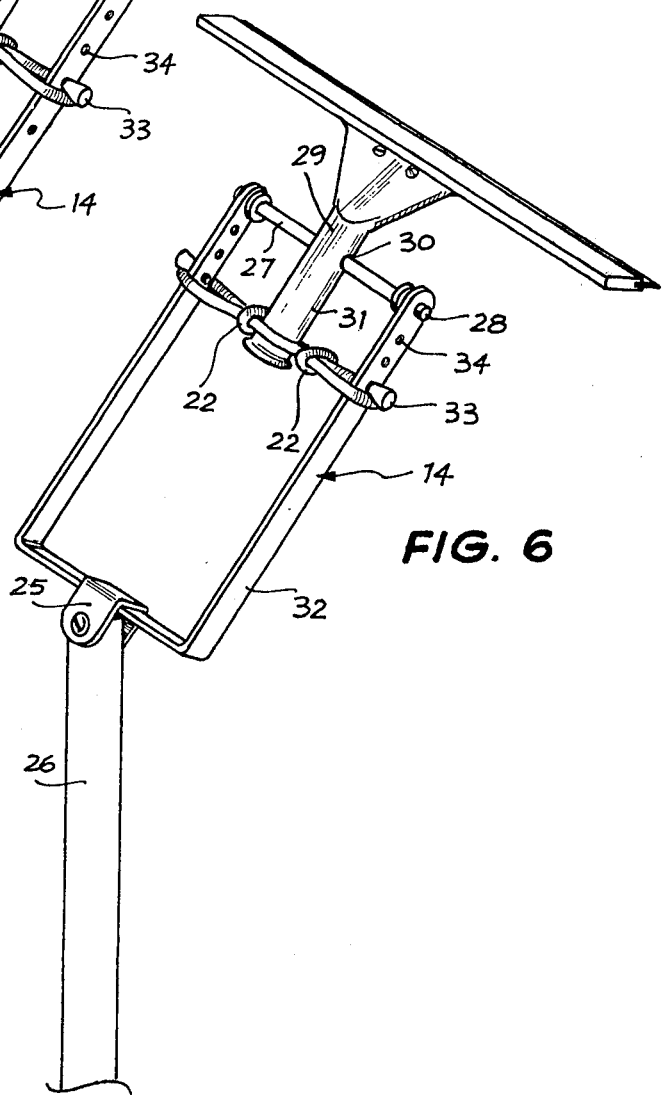
FIG. 6

HOLDER FOR AN IMPLEMENT

This invention relates to holders for implements.

It is known to connect an implement such as paint brush, a paint roller or a squeegee to pole in order to avoid using a ladder and yet reach normally inaccessible positions. The need for a holder for such implements which gives a degree of flexibility, as is normally achieved by wrist movement with hand held implements, has been apparent for some time.

This invention achieves the foregoing object and at the same time allows the degree of flexibility to be readily adjusted. In this way the angle of attack of the implement to the surface being treated and the pressure applied to the implement can be readily controlled.

The invention in its broadest sense comprises a holder for an implement, said holder comprising a body, coupling means on said body to receive a handle, an elongated implement support part of said body, a pair of co-axial pivot points respectively located on each of two elongated spaced and aligned parts of said implement support to pivotally support an implement and resilient means connecting said two spaced aligned parts and adapted to engage portion of an implement when pivotally mounted therebetween and resiliently restrain pivotal movement of said implement.

The two embodiments of the drawing are described hereunder with reference to the accompanying drawings in which: FIG. 1 is an elevation of one embodiment of the holder.

FIG. 6 is a perspective view of a second simple embodiment of the holder with a mounted brush and FIG. 7 is a view similar to FIG. 6 showing a squeegee mounted in the holder.

Figure 1:
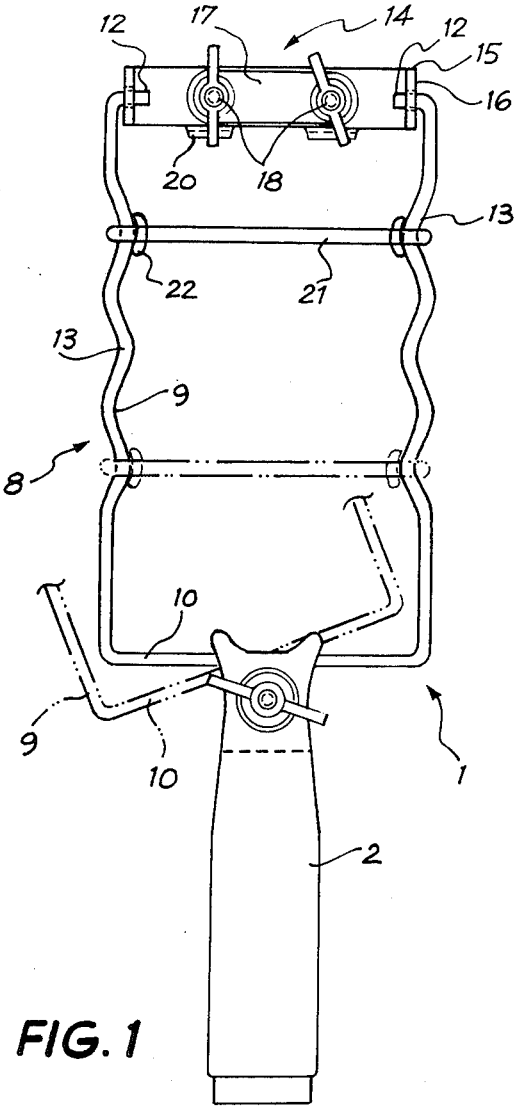
Figure 2:
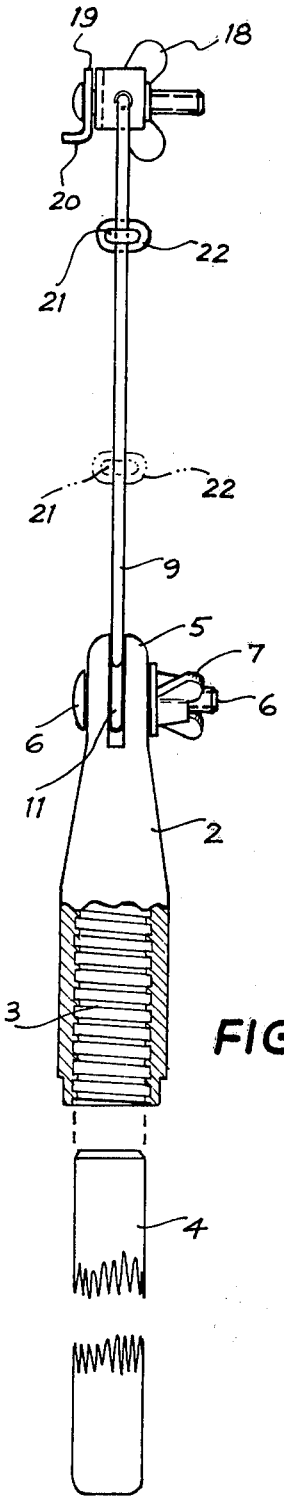
FIG. 2 is a side view of the holder of FIG. 1.
Figure 3:
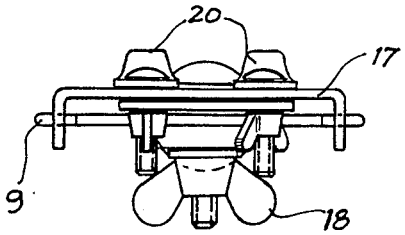
FIG. 3 is a view from above of the holder of FIG. 1.

The holder 1 comprises a handle 2 which has a tubular portion which has an internally threaded bore 3. A handle lengthening member 4 is adapted to be threaded or otherwise installed in the handle bore 3.

The other end of the handle is bifurcated so as at to provide two legs 5 in which a clamping bolt 6 and wing-nut 7 combination is mounted.

An implement support 8 is mounted on the handle 2. The implement support 8 is of generally U form with two legs 9 and a base 10 and a lug 11 disposed between the handle legs 5. There is a hole in lug 11 to accept the bolt 6, the implement support can be pivoted about the bolt 6 (as shown in dotted lines FIG. 1) and can be held clamped in a pivotted position by the bolt and wing-nut combination.

The form of the implement support illustrated is simple, it is made from circular cross-section rod with the ends of the legs turned towards each other to provide a pair of co-axial pivot pins 12. The legs 9 are notched or bent as at 13.

The implement clamp 14 comprises a pair of bars, one bar 15 has upturned ends 16 with holes to receive the pins 12 which pivotally support the bar 15. The other bar 17 is flat, although it may be shaped to locate over a correspondingly shaped part of an implement of a brush handle and two bolt/wing-nut fastenings 18 passing through holes in the bars 15–17 are used to clamp the implement between the bars.

It is to be noted that the washers 19 beneath the heads of the bolts 18 have lugs 20, to be considered later.

The two legs 9 are encircled by an elastic band 21 which can be located in one of several possible positions depending upon which of the notches 13 are engaged. For security reasons a small retainer band 22 is mounted at each end of the band 21. The band applies a reaction force to oppose forces tending to pivot the brush when in use. It also applies a restraining force to prevent paint "flick" when the painting force is suddenly released and the brush flips back to normal position.

An implement, e.g. a paint brush, can be clamped between the plates 15–17 with the handle within the band. Looking at FIG. 4 it will be seen that as the band is moved down, toward the handle, the application of the same force F will result in less angular deflections of the brush. This is due to the increase of lever arm length requiring more extension of the band, as the band is moved down, for the same angular deflection of the brush.

Thus with the band 21 at position P1 the lever arm L1 is small so the deflection angle a1 is large. When the band is a portion P2 the lever arm L2 is longer and the angle a2 is smaller and likewise with the band at P3 the lever arm L3 is large and the angle A3 is smallest. In this way the degree of operation resistance can be readily varied. The depth of the bends 13 can be varied to provide a further variation of resistance to force F which is not proportional to the lever arm L. For example the bends 13 can be smaller at P3 to increase the tension on the band than they are at P1 where the band would be under less tension. Another way of obtaining a resistance to force F is to have the band running from a bend at L1 to a bend at L2, the diagonal band would thus have a tension different from its tension at any one of the three normal possible positions.

Figures 4, 5:
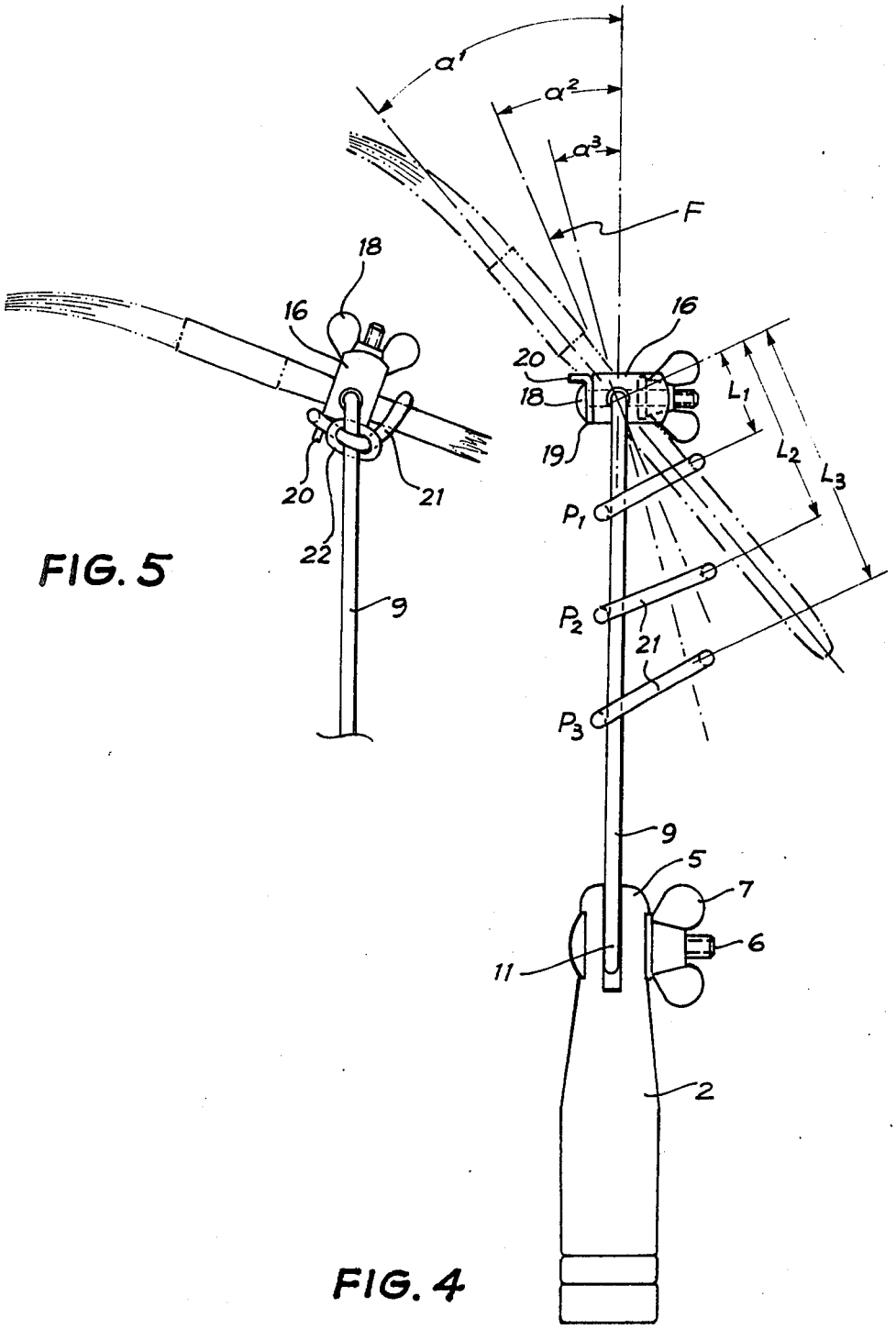
FIG. 4 is a view similar to FIG. 2 showing a paint brush mounted in the holder.
FIG. 5 is a fragmentary view similar to FIG. 4 showing another arrangement of the brush.

In FIG. 5 it will be seen that the band 21 has been moved upward to lock over lugs 20. In this position the band pulls the brush to an angled relationship to the neutral position, i.e. aligned with the implement support 8. The angled brush is thus suitably oriented for "cutting in" around corners and the like whilst still being resiliently held in the angled position.

It is to be understood that the pivot pins and holes previously described can be reversed to provide holes in the implement holder and pins on the implement clamp.

In FIG. 6 a very simple arrangement will be seen. It comprises a U frame 14 of rectangular steel with a simple pivot clip 25 on the base of the U to enable a pole 26 to be coupled to the frame 14. A tube 27 or a hollow ended bar extends between the pivot pins 28 and a squeegee 29, with a hole 30 to receive the tube 27. The squeegee handle 31 is received in the elastic band 21. The band 21 is around the U frame legs 32 and is held in position by pegs 33 in holes 34 in the U legs 32. The rings 22 laterally locate the handle 31.

It is also within the scope of the invention for the handle 31 of the squeegee to be fixed to the bar/tube 27.

In FIG. 7, the frame 14 of FIG. 6 is modified in that a wide paint brush 35 has side holes or pins which are pivotally associated with the frame legs 32.

The same arrangement as described with reference to FIGS. 6 and 7 can be provided using the round section bar 9 of FIGS. 1 to 5.

It will be seen that almost any implement of the paint brush, paint roller or squeegee type can be used in the holder of this invention.

I claim:

1. A holder for an implement, said holder comprising a body, a handle, coupling means on said body to receive said handle, an elongated implement support part of said body, a pair of co-axial pivot pins respectively located on each of two elongated spaced and aligned parts of said implement support to pivotally support an implement, resilient means connecting said two spaced aligned parts and engaging a portion of an implement when pivotally mounted therebetween and resiliently restrain pivotal movement of said implement, a pivotal clamping connection between the handle and said implement support with its axis of pivoting at right angles to the axis of pivoting of said implement relative to the implement support, said resilient means comprising an elastic band extending around said implement support, correspondingly positioned restraining means in said spaced aligned parts to allow positioning of said band at one of several possible locations along said implement support between said handle and said pivot pins.

2. A holder as claimed in claim 1 including an implement clamp pivotally mounted at said pivot pins.

3. A holder as claimed in claim 1 wherein the restraining means comprises notches in the spaced aligned parts.

4. A holder as claimed in claim 3 where the notches decrease in depth to increase band tension as it moved away from said pivot points.

5. A holder as claimed in claim 1 wherein said implement support is a U shaped frame of metal rod with the free ends of the legs of the U turned towards each other to form said pivot pins, a lug on the base of the U with a hole therethrough to allow pivotal connection to said handle and correspondingly positioned notches in the U legs to provide location means between the pivot pins and the base of the U for said elastic band.

6. A holder as claimed in claim 5 wherein said implement clamp is a pair of bars, one bar being of U shape, the legs having holes to receive said pivot pins and securing means to draw the bars together in a clamping action.

7. A holder as claimed in claim 1 wherein the handle is internally threaded to receive a correspondingly threaded pole forming an extension of said handle.

* * * * *